United States Patent [19]

Hagstrom

[11] 4,274,237

[45] Jun. 23, 1981

[54] HOLDER FOR A DECORATIVE TRIM STRIP

[75] Inventor: Arthur A. Hagstrom, Hoffman Estates, Ill.

[73] Assignee: Teletype Corporation, Skokie, Ill.

[21] Appl. No.: 63,613

[22] Filed: Aug. 3, 1979

[51] Int. Cl.[3] ..... B44F 7/00

[52] U.S. Cl. ..... 52/312; 52/716

[58] Field of Search ..... 52/312, 716, 717, 471, 52/287, 288

[56] References Cited

U.S. PATENT DOCUMENTS

| | | | |
|---|---|---|---|
| 2,549,414 | 4/1951 | Bonnell | 311/107 |
| 2,705,820 | 4/1955 | Torrence | 20/74 |
| 3,594,972 | 7/1971 | Jones | 52/716 |
| 3,710,522 | 1/1973 | Fritz et al. | 52/716 X |
| 3,991,537 | 11/1976 | Brown | 52/312 X |
| 4,008,551 | 2/1977 | MacDonald et al. | 52/316 |

FOREIGN PATENT DOCUMENTS

| | | | |
|---|---|---|---|
| 86275 | 12/1958 | Denmark | 52/312 |

*Primary Examiner*—Price C. Faw, Jr.
*Assistant Examiner*—Carl D. Friedman
*Attorney, Agent, or Firm*—J. C. Albrecht; W. K. Serp

[57] ABSTRACT

A trim strip holder 10 includes a channel 18 defined by parallel opposed first and second ledges 28, 30 and includes elongated first and second recesses 24, 26 located adjacent to and coextensive with the ledges 28, 30. A raised ridge 22 extends the length of the channel 18 and is disposed between the recesses 24, 26. A surface of the first ledge defines a notch 36 coextensive with the ledge 28. A surface 40 of the notch 36 is spaced from and parallel to a wall 42 of the second recess 26. A flat elongated trim strip 20 is positioned to seat within the notch 36 and the second recess 26 and is held in place by the ridge 22.

3 Claims, 4 Drawing Figures

HOLDER FOR A DECORATIVE TRIM STRIP

DESCRIPTION

Technical Field

This invention relates to a holder for a decorative trim strip particularly adapted to facilitate convenient removal and insertion of the trim strip.

BACKGROUND ART

Desks, Cabinets and other types of enclosures which serve as equipment housings for electronic devices are often decorated with a trim strip having embossed or printed thereon the manufacturer's or retailer's trademark or other logo. Often a first manufacturer will sell an enclosure to a second manufacturer who includes the enclosure in his product which is then sold to the ultimate user. Under such circumstances, the second manufacturer may remove the first manufacturer's trim strip and replace it with his own. Alternatively, the ultimate user may remove the seller's trim strip replacing it with one displaying his own trademark or logo. This trim strip exchange procedure is often complicated by the fact that the enclosure must be partially or completely disassembled to allow insertion of a new trim strip. Such procedures are not only expensive but also subject the equipment to possible damage. The hereinafter described embodiment of this invention, provides a decorative trim strip holder which allows removal and reinsertion of a trim strip without the necessity for disassembling the associated enclosure.

SUMMARY OF THE INVENTION

In accordance with this invention, an elongated trim strip holder has a longitudinally oriented open trim channel for receiving a generally flat elongated flexible trim strip. The opening of the channel is defined by parallel opposed first and second ledges. The holder has within the channel a pair of opposed, parallel, first and second recesses spaced apart by a distance greater than the width of the trim strip to be accommodated. Each of the first and second recesses are located adjacent and coextensive with a respective one of the first and second ledges. A raised, elongated ridge extends the length of the channel and is disposed between the first and second recesses. A surface of the first ledge has a notch coextensive with the first ledge with a surface of the notch being spaced from and parallel to the longitudinal axis of the second recess. The distance between the opposing surfaces of the notch and a wall defining the second recess is substantially equal to the width of the trim strip so that when a trim strip is placed within the channel it will be securely held in place by the notch and said second recess in cooperation with the ridge.

DETAILED DESCRIPTION

Figure 1:
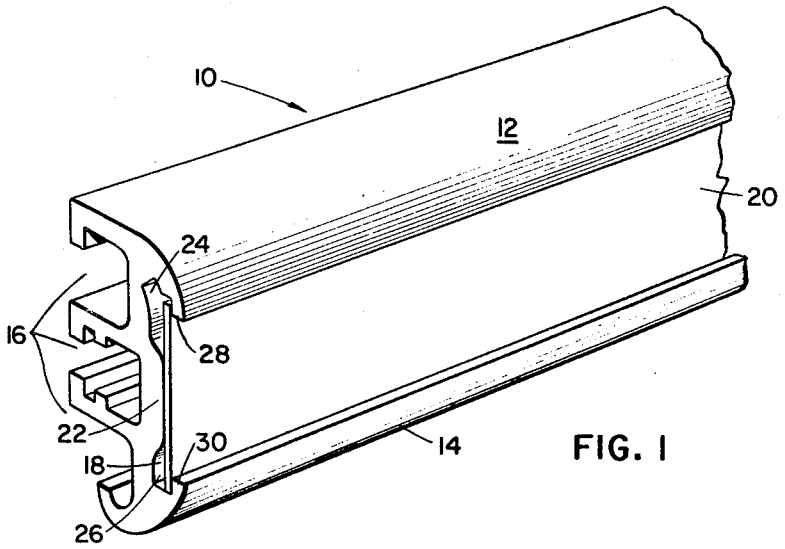
FIG. 1 is a perspective view of a trim strip holder in cooperation with a trim strip.
Figure 2:
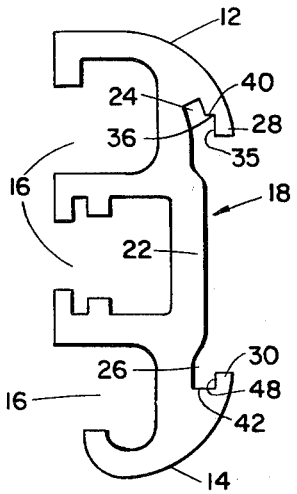
FIG. 2 is an end view of the trim strip holder of FIG. 1.

A trim holder 10 is illustrated in FIGS. 1 and 2 which may be formed by extruding aluminum, by plastic molding or other suitable means. The holder 10 displays rounded outer edges 12 and 14 providing a pleasing appearance and a shaped elongated mounting channel 16 which serves to secure the holder to the enclosure with which it is associated. The mounting channel 16 is not part of the invention and therefore will not be considered in greater detail. The outwardly disposed surface of the holder 10 is shaped to define an elongated trim channel 18 for receiving and securely retaining a decorative, relatively flat, flexible, trim strip 20. Located within the trim channel 18 is a raised, flat ridge 22 the width of which is less than the opening to the trim channel 18. Positioned on each side of the raised ridge are elongated, longitudinally oriented recesses 24 and 26. Extending over and defining the recesses 24 and 26 are opposed trim retaining ledges 28 and 30 which define the channel opening. It will be appreciated that the walls of the holder 10 which define the lower recesses 26 are substantially straight. The ridge 22 is positioned closer to the lower ledge 30 so that the upper recess 24 is longer than the lower recess 26 thus facilitating entry and removal of the trim strip 20 as will be subsequently more fully appreciated.

Figure 3:
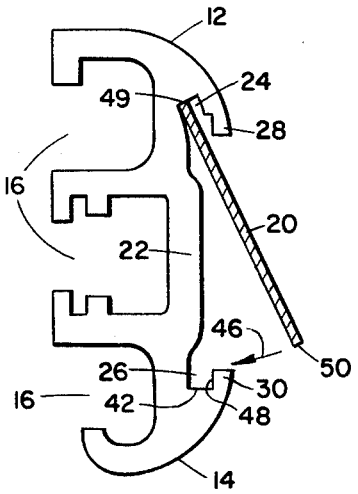
FIG. 3 is an end view of the trim strip holder of FIG. 2 having a trim strip partially engaged therewith during the insertion process.
Figure 4:
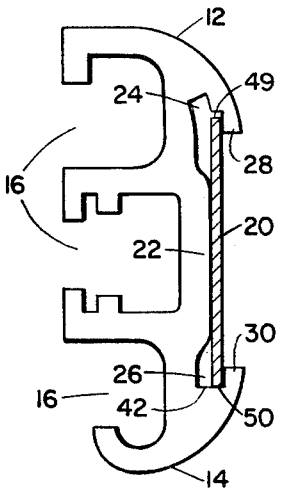
FIG. 4 is an end view of the trim strip holder of FIG. 2 with a trim strip fully engaged therewith.

In accordance with this invention, a surface 35 of the ledge 28 which defines the recess 24 also defines a coextensive, elongated notch 36. The distance between a surface 40 of the notch 36 and a wall 42 of the opposite recess 26 is approximately the width of the trim strip 20. With particular reference to FIGS. 3 and 4, the trim strip 20 is installed in the trim channel 18 by inserting one longitudinal edge 49 of the trim strip 20 into the upper recess 24 and thereafter forcing the trim strip downwardly against the surface of the ridge 22, in the direction of the arrow 46, until the free edge of the trim strip clears a wall 48 of the ledge 30. Thereafter, the strip 20 is forced downwardly across the surface of the ridge 22, into the lower recess 26. As the trim strip 20 moves downwardly it drops into the notch 36 under bias of the ridge 22 and is held securely in place. To remove the trim strip 20, the upper longitudinal edge thereof is deflected into the recess 24 and the trim strip is forced upwardy into the upper recess 24. As the strip 20 moves upwardly, an opposite longitudinal edge 50 will release from the lower recess 26. The relatively large size of the upper recess 24 provides the necessary clearances to allow convenient insertion and removal of the trim strip 20.

A holder has been described which allows convenient insertion and removal of a trim strip. Although a single embodiment of the invention has been shown and described, it will be understood that various changes in form and detail may be made without departing from the scope and spirit of the invention as set forth in the following claims:

What is claimed is:

1. An elongated trim strip holder 10 defining a longitudinally oriented open trim channel 18 for receiving a generally flat, elongated trim strip 20, the opening of said channel 18 being defined by parallel, opposed, first and second ledges 28, 30 said holder 10 further defining within said trim channel 18 a pair of opposed, parallel, first and second recesses 24, 26 spaced apart by a distance greater than the width of the trim strip 20 to be accommodated, each of said first and second recesses 24, 26 being located adjacent and coextensive with a respective one of said first and second ledges 28, 30, a raised, elongated ridge 22 extending the length of said channel 18 and disposed between said first and second recesses 24, 26, characterized in that:

a surface of said first ledge 28 defining said first recess 24 defines a notch 36 coextensive with said first ledge 28; a surface 40 of said notch 36 is spaced from and generally parallel to the longitudinal axis of said second recess 26; the distance between said notch surface 40 and a wall 42 defining the second recess 26 is substantially equal to the width of the trim strip 20; the distance between the wall of said first recess 24 and the opposite edge of said second ledge 30 is greater than the width of the trim strip 20 so that the trim strip 20 may be freely placed within said channel 18 without substantial deformation of the trim strip 20 and will be securely held in place by the notch 36 and said second recess 26 in cooperation with said ridge 22.

2. The holder of claim 1, characterized in that:

said ridge 22 displays a flat surface disposed toward the opening of the trim channel 18.

3. The holder of claim 2, characterized in that:

said first and second recesses 24, 26 are defined by planar walls and said notch 36 is defined by at least one planar wall 35 substantially parallel to the surface of said ridge 22.

* * * * *